US006725703B1

(12) United States Patent
Johnson

(10) Patent No.: US 6,725,703 B1
(45) Date of Patent: Apr. 27, 2004

(54) HINGE ADJUSTMENT TOOL AND METHOD OF USE

(76) Inventor: Richard E. Johnson, 9915 Rancho Dr., Bakersfield, CA (US) 93311

( * ) Notice: Subject to any disclaimer, the term of this patent is extended or adjusted under 35 U.S.C. 154(b) by 0 days.

(21) Appl. No.: 10/323,141

(22) Filed: Dec. 18, 2002

(51) Int. Cl.[7] ..... B21D 7/022; B21D 19/00

(52) U.S. Cl. ..... 72/458; 72/457; 72/479; 29/275; 29/283.5; 81/176.1; 81/176.3

(58) Field of Search ..... 72/457, 458, 479; 29/275, 283.5; 81/176.1, 176.3

(56) References Cited

U.S. PATENT DOCUMENTS 780,756 A * 1/1905 Lakin ..... 72/479
1,078,829 A * 11/1913 Carpenter ..... 72/479
1,747,136 A * 2/1930 Putnam ..... 72/458
2,732,743 A * 1/1956 Hart ..... 72/458
4,034,595 A * 7/1977 Smith ..... 72/458
6,450,003 B1 * 9/2002 Pawson ..... 72/457

* cited by examiner

*Primary Examiner*—David B Jones
(74) *Attorney, Agent, or Firm*—James M. Duncan

(57) ABSTRACT

The disclosed apparatus is a tool for adjusting a hinge. The tool comprises a head having a first jaw portion and an opposite-facing second jaw portion. The first jaw portion and the second jaw portion define an opening which has the same shape as a cross-section of the knuckles of the hinge. The apparatus further comprises a handle attached to the head. Because the tool engages the knuckles of the hinge at the back of the knuckles, there is no unsightly scratching of the hinge. A method of use of the tool is also disclosed.

18 Claims, 4 Drawing Sheets

HINGE ADJUSTMENT TOOL AND METHOD OF USE

BACKGROUND OF THE INVENTION

The present invention relates to an apparatus and method for adjusting door and cupboard hinges, and more particularly to a tool which slips over the knuckles of a hinge, allowing the knuckles to be bent away or toward the hinge plate which attaches the hinge either to the door or to the doorjamb.

Doors often stick or become stuck within the doorframe as a result of either settling of the frame of the structure, excessive moisture, a damaged door, or if a replacement door is installed, because no doorway is perfectly level or plumb. A sticking door can, at the least, be a source of aggravation. Different methods are often employed to remedy a sticking door, such as trimming or shaving the door at the point where it sticks, or adjusting the hinge to pull the door away from the point where it sticks within the door frame.

One method commonly employed to adjust the hinges of a door is to place a crescent wrench over the knuckles of the hinge and apply a force to the end of the wrench, thereby increasing or decreasing the angle between the knuckles and the hinge plate. For example, if the door rubs on the top of handle side of the door, the retaining pin may be pulled from the top hinge and the door leaned away from the doorjamb, separating the hinge leaf attached to the door from the hinge leaf attached to the doorjamb. The crescent wrench may then be placed over the knuckles on the hinge leaf attached to the doorjamb and the knuckles bent toward the doorjamb. Once the hinge is placed back together, the door will be pulled closer to the jamb and pulled away from the door frame on the handle side.

The problem with using the above method is that the crescent wrench scratches the knuckles, damaging the appearance of the hinge. The present apparatus and method are directed toward this problem.

SUMMARY OF THE INVENTION

The present invention is directed to an apparatus and method which meets the need identified above.

The disclosed apparatus is a tool for adjusting a hinge, the hinge being the type comprising two leafs, each leaf having a plurality of knuckles on the edge of the leaf through which, when the knuckles are aligned, a retaining pin is passed to connect the two leafs. The tool comprises a head having a first end and a second end. The head further comprises a first jaw portion and an opposite-facing second jaw portion. The first jaw portion and the second jaw portion define a knuckle-enclosing opening having the same shape as a cross-section of the knuckles. The apparatus further comprises a handle attached to the second end of the head.

Another embodiment of the apparatus comprises a head having a first end and a second end. The head further comprises a first jaw portion and an opposite-facing second jaw portion. The first jaw portion and the second jaw portion define a knuckle-enclosing opening. The knuckle-enclosing opening has a slot shape at the first end. The knuckle-enclosing opening transitions into a circular shape as the opening extends in the-direction of the second end. The apparatus further comprises a handle attached to the second end of the head.

Methods of using the tools described above are also disclosed.

These and other features, aspects, and advantages of the present invention will become better understood with regard to the following description, appended claims, and accompanying drawings.

DETAILED DESCRIPTION OF THE EMBODIMENTS

Figure 1:
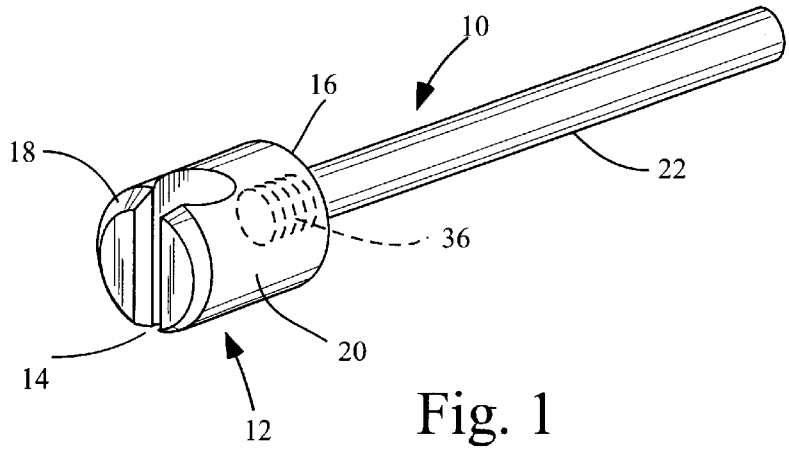
FIG. 1 is an isometric view of one embodiment of the disclosed apparatus.
Figure 2:
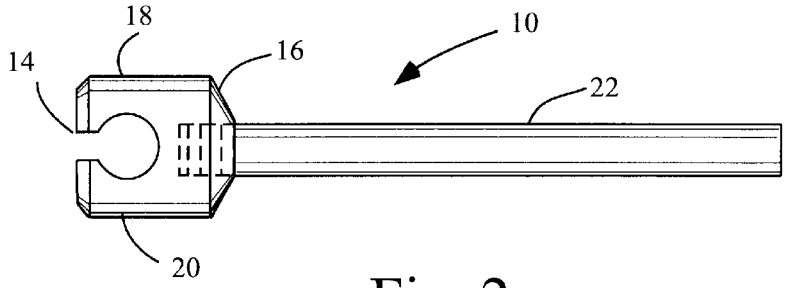
FIG. 2 is a side view of the embodiment shown in FIG. 1.
Figure 3:
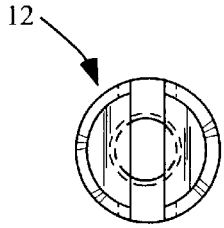
FIG. 3 shows a front view of the embodiment shown in FIG. 1.
Figure 4:
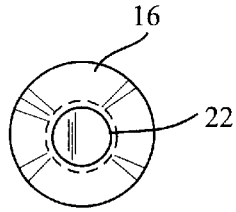
FIG. 4 shows a rear view of the embodiment shown in FIG. 1.

Referring now specifically to the drawings, FIG. 1 shows a perspective view of one embodiment 10 of the hinge adjustment tool. One embodiment of the tool comprises a head 12 having a first end 14 and a second end 16. The head further comprises a first jaw portion 18 and an opposite-facing second jaw portion 20. A handle 22 is attached to the second end 16 of the head 12. FIG. 2 shows a side view of this embodiment 10 of the device, showing a side view of the opening 24 defined by the first jaw portion 18 and the second jaw portion 20.

Figure 6:
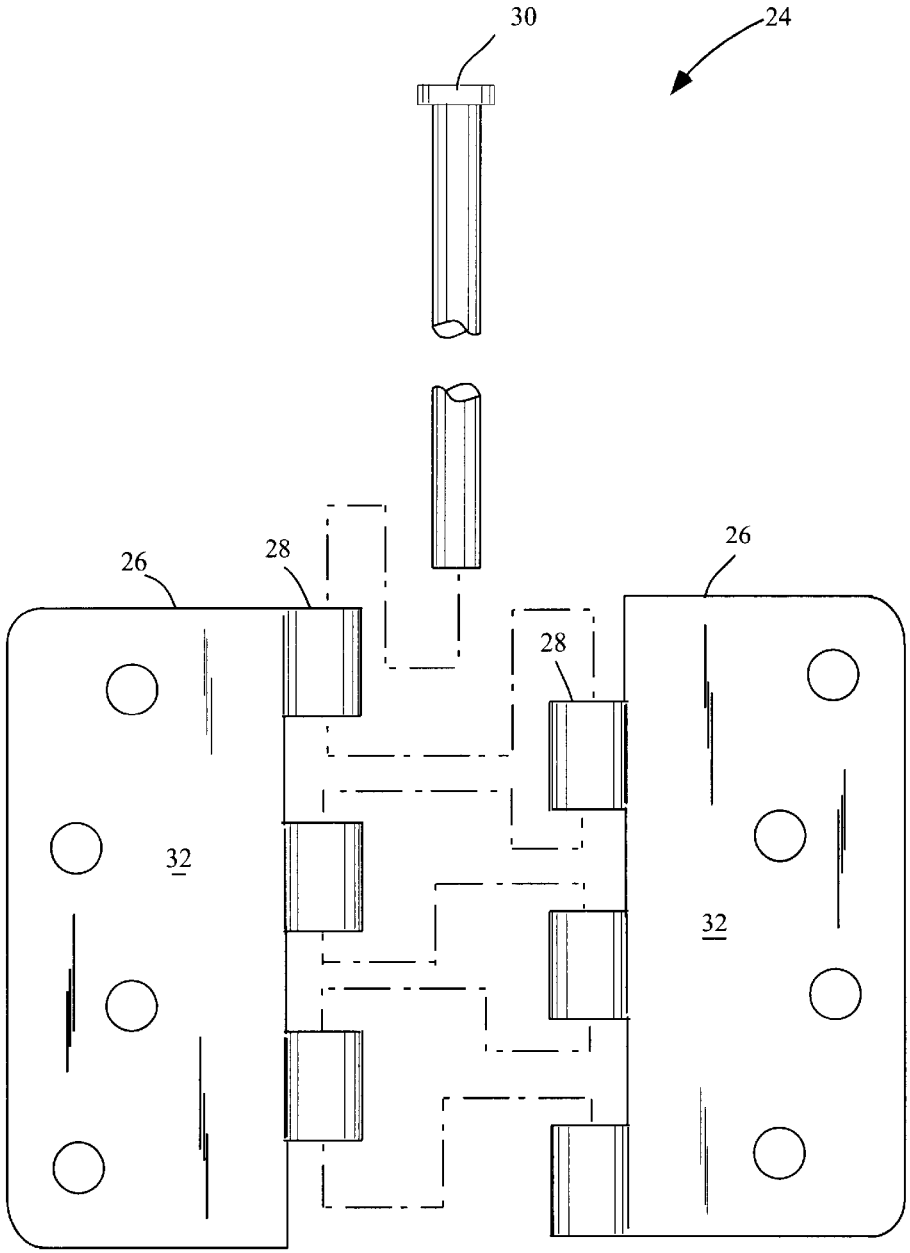
FIG. 6 shows one type of hinge which may be adjusted with the disclosed apparatus.

This tool may be used to adjust different types of hinges, including the type hinge 24 shown in FIG. 6. This type of hinge 24 comprises two leafs 26, each leaf having a plurality of knuckles 28 on the edge of the leaf through which a retaining pin 30 is passed to connect the two leafs. The leaf 26 is that portion of the hinge 24 which extends laterally from the knuckles 28, which generally revolves around the retaining pin 30. The portion of leaf 26 which extends laterally from the knuckles 28, but which does not include the knuckles shall be referred to herein as the leaf plate 32.

Figure 7:
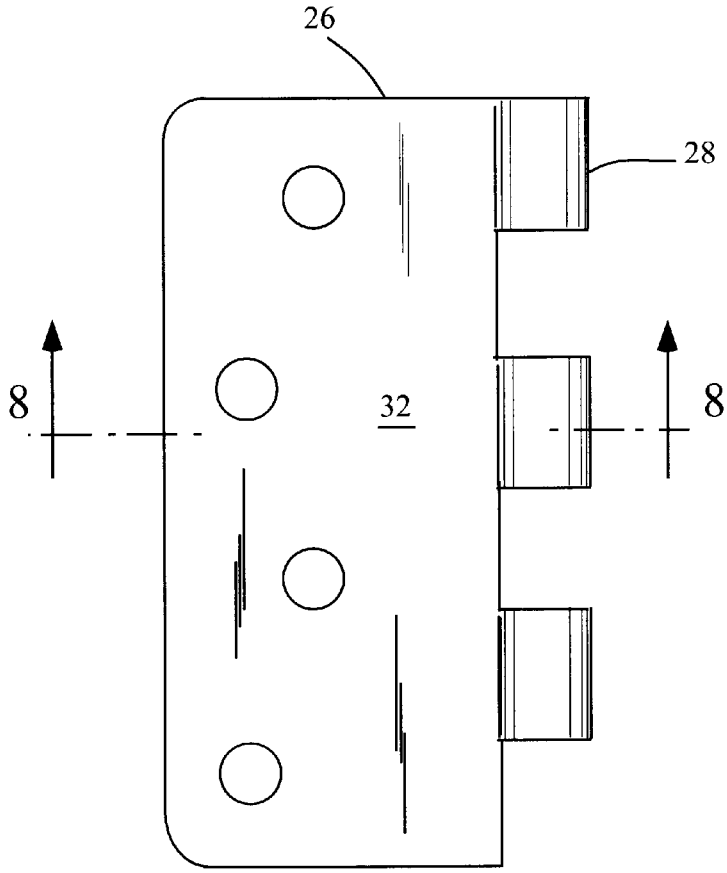
FIG. 7 shows a leaf of the hinge shown in FIG. 6.
Figure 8:
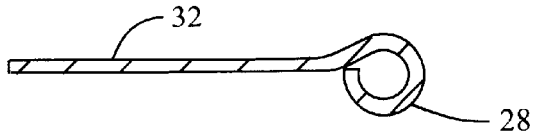
FIG. 8 is a cross section taken on line 8—8 of FIG. 7.
Figure 9:
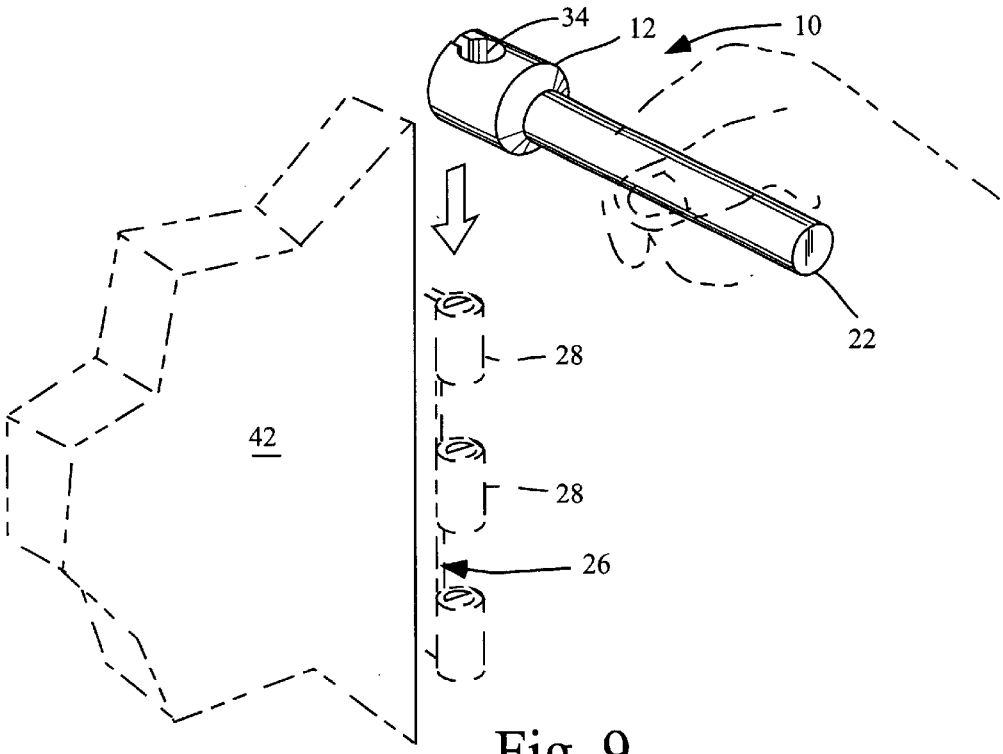
FIG. 9 shows an embodiment of the disclosed device being placed over the knuckles of a hinge leaf.
Figure 10:
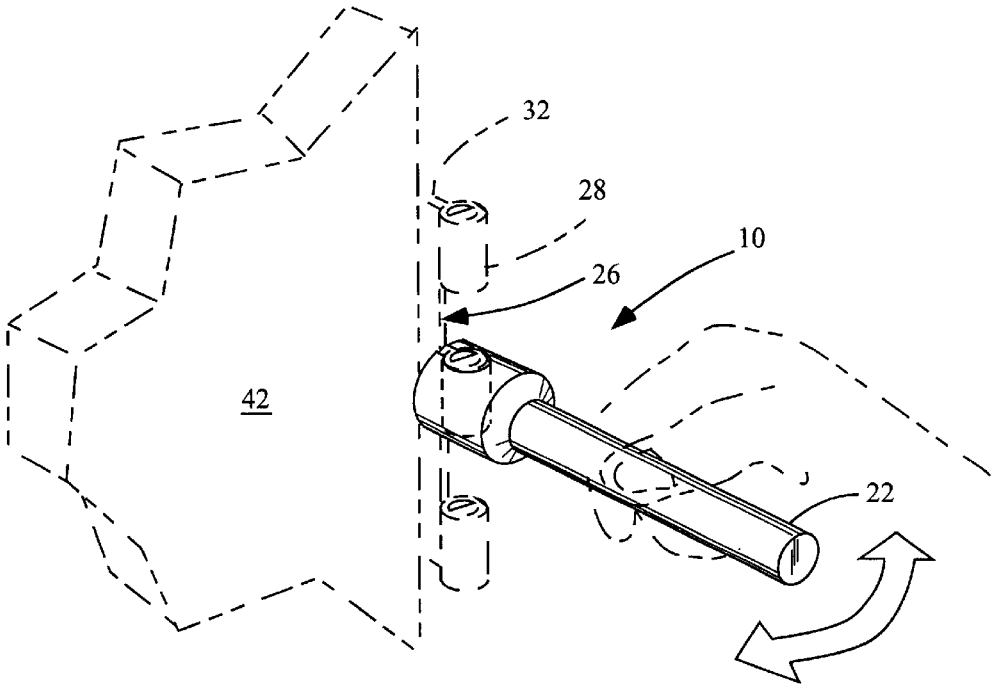
FIG. 10 shows an embodiment of the disclosed device being used to adjust a hinge.

The first jaw portion 18 and the second jaw portion 20 of this embodiment 10 of the hinge adjustment tool define a knuckle-enclosing opening 34. As shown in FIG. 7 and FIG. 8, the knuckle-enclosing opening 34 has the same shape as a cross-section of the knuckles 28, although the dimensions of knuckle-enclosing opening 34 are slightly larger than the dimensions of knuckles 28 so that the knuckle-enclosing opening may slide over the knuckles as shown in FIGS. 9 and 10. The point of contact between the knuckle 28 and the knuckle-enclosing opening 34 is at the back of the knuckle, where the knuckle transitions into the leaf plate 32. Because the knuckle-enclosing opening conforms to the shape of the knuckle 28, the tool 10 does not engage the knuckle at its front or sides, but rather at the back of the knuckle 28, so there is no unsightly scratching of the front or side surfaces of the knuckle when the tool is used.

It is to be appreciated that the shape of the knuckle-enclosing opening 34 may be changed as the shape of the cross-section of the knuckles of a particular hinge changes. FIG. 2 shows that one embodiment of the device may comprise a knuckle-enclosing opening 34 which comprises a slot at the first end 14 of the head 12. The slot transitions into a circular shape as the knuckle-enclosing opening extends in the direction of the second end 16.

Figure 5:
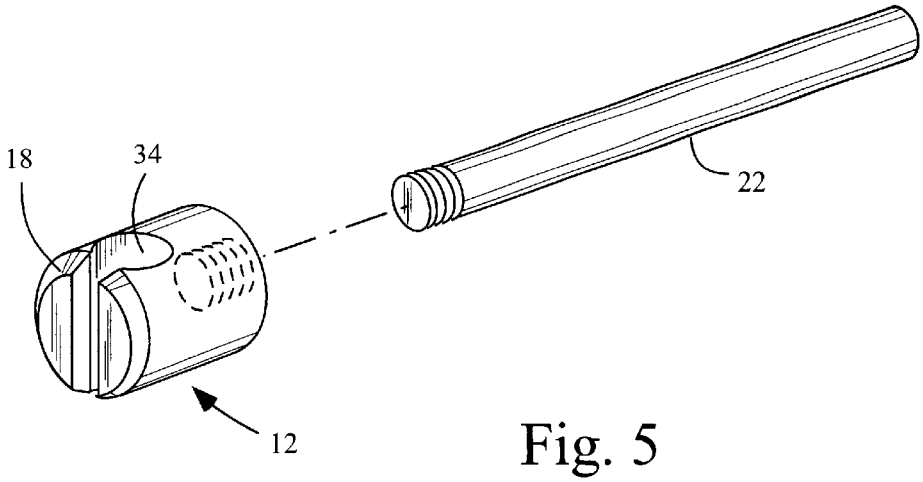
FIG. 5 shows an exploded view of the embodiment shown in FIG. 1.

As indicated in FIGS. 1, 2 and 5, the head 12 of the device may be attached to the handle 22 with a threaded connection 36. In this embodiment, changeable heads may be used with the same handle, where a different head is required because of the shape or size of the hinge. However, it is to be appreciated that the tool may also be either cast or tooled from a single piece of stock such that the handle 22 is an integral part of the head 12, rather than two separate parts. It is also to be appreciated that because the device is used to change the angle between the knuckles 28 and the leaf plate 32, the material used to fabricate the device must, at a minimum, have a hardness greater than that of the hinge material.

It is also to be appreciated that the head 12 might be other shapes than the cylindrical shape shown in FIGS. 1 through 5. For embodiments utilizing a head 12 having a cylindrical shape, the first end 14 of the head may have a beveled edge 38. Likewise, second end 16 may also have a beveled edge 40 as shown in FIG. 2. For some hinges, the cylindrical shape of the head 12 and the beveled edges 38 and 40 may make use of the tool easier and more maneuverable.

It is also to be appreciated that the dimensions of a particular embodiment of the device may vary according to the size of the hinge to be adjusted. However, for a particular hinge size, some dimensions may be preferred. For example, an embodiment which may be used to adjust standard size hinges used in residential housing has a head 12 which is 1.25 inches in length, from the first end 14 to the second end 16. The outside diameter of the cylindrical head may be 1.0 inch. The overall length of the embodiment is 6.5 inches. The knuckle-enclosing opening 34 may have a slot which has an opening 7⁄32 inches and a length of 0.085 inches and circular shape having a diameter of ½ inch. Handle 22 may either be plain finish, or knurled to provide improved grip. The handle might also have a slip-on grip of leather, rubber or other material. The handle might also have a flat section or bend-it which allows the user to place a tool, such as pliers or wrench, to assist in adjusting a hinge. Beveled edge 38 on the first end 14 might have an angle of 45 degrees. Beveled edge 40 on the second 16 might have an angle of 30 degrees.

However, it is to be appreciated that these dimensions may change according to the size of the hinges the user desires to adjust.

FIGS. 9 and 10 illustrate how the device 10 may be used. Retaining pin 30 is removed so that the first leaf 26 may be separated from the second leaf, leaving the leaf 26 to be adjusted attached to its anchoring structure 42, either the door itself or, more commonly, to the leaf attached to the doorjamb. The user should make sure the first leaf 26 is firmly attached to the anchoring structure, because the leaf might otherwise be pulled off of the anchoring structure when force is applied to the device 10, resulting in a torque applied to the leaf. The device is slipped over the knuckles 28, such that the knuckle-enclosing opening 34 surrounds a knuckle. By applying a force to handle 22, the angle between the knuckles 28 of the first leaf 26 and the plate section 32 is changed, which will result in the door being moved laterally within the door frame. The tool is removed from the knuckles of the first leaf 26 and the door replaced. The door is adjusted a little at a time until the desired spacing is achieved. The retaining pin 30 is then reinserted into the aligned knuckles 28 of the first leaf and second leaf.

While the above is a description of various embodiments of the present invention, further modifications may be employed without departing from the spirit and scope of the present invention. For example, the size, shape, and/or material of the various components may be changed as desired. Thus the scope of the invention should not be limited by the specific structures disclosed. Instead the true scope of the invention should be determined by the following claims.

What is claimed is:

1. A tool for adjusting a hinge, the hinge being the type comprising a first leaf and a second leaf, each leaf laterally attached to a plurality of knuckles on the edge of each leaf and a retaining pin is passed through the aligned knuckles of the first leaf and second leaf to connect the two leafs, the tool comprising:

(a) a cylindrical head having a first diameter, a first end and a second end, the first and second end defining a first axis, the head further comprising a first jaw portion and an opposite-facing second jaw portion, the first jaw portion and the second jaw portion defining an opening having the same shape as a cross-section of the knuckles; and (b) a handle having a second diameter attached to the second end of the head, the handle defining a second axis wherein the first axis and the second axis coincide and the first diameter is larger than the second diameter.

2. The hinge adjustment tool of claim 1 wherein the head is attached to the handle with a threaded connection.

3. The hinge adjustment tool of claim 1 wherein the first end of the head has a beveled edge.

4. The hinge adjustment tool of claim 1 wherein the second end of the head has a beveled edge.

5. A hinge adjustment tool comprising:

(a) a cylindrical head having a first diameter, a first end and a second end, the first and second end defining a first axis, the head further comprising a first jaw portion and an opposite-facing second jaw portion, the first jaw portion and the second jaw portion defining a knuckle-enclosing opening, the knuckle-enclosing opening having a slot shape at the first end, transitioning into a circular shape as the knuckle-enclosing opening extends in the direction of the second end; and (b) a handle having a second diameter attached to the second end of the head, the handle defining a second axis wherein the first axis and the second axis coincide and the first diameter is larger than the second diameter.

6. The hinge adjustment tool of claim 5 wherein the head is attached to the handle with a threaded connection.

7. The hinge adjustment tool of claim 5 wherein the first end of the head has a beveled edge.

8. The hinge adjustment tool of claim 5 wherein the second end of the head has a beveled edge.

9. A method of adjusting a hinge, the hinge being the type comprising a first leaf and a second leaf, each leaf having a plate section and a plurality of knuckles extending laterally from the plate section, a retaining pin inserted through the knuckles of the first leaf and second leaf to connect the two leafs, and the first leaf securely anchored, the method comprising the steps of:

(a) removing the retaining pin from the knuckles of the first leaf and the second leaf;

(b) slipping a hinge adjustment tool over the knuckles of the first leaf, the hinge adjustment tool comprising: (i)

a head having a first end and a second end, the head further comprising a first jaw portion and an opposite-facing second jaw portion, the first jaw portion and the second jaw portion defining an opening having the same shape as a cross-section of the knuckles and (ii) a handle attached to the second end of the head;

(c) applying a force to the handle to change the angle between the leaf plate of the first leaf and the knuckles of the first leaf until a desired angle is achieved;

(d) removing the hinge adjustment tool from the knuckles of the first leaf; and (e) reinserting the retaining pin into the aligned knuckles of the first leaf and the second leaf.

10. The method of claim 9 wherein the head of the hinge adjustment is attached to the handle with a threaded connection.

11. The method of claim 9 wherein the head of the hinge adjustment tool is cylindrical in shape.

12. The method of claim 11 wherein the first end of the head of the hinge adjustment tool has a beveled edge.

13. The method of claim 11 wherein the second end of the head of the hinge adjustment tool has a beveled edge.

14. A method of adjusting a hinge, the hinge being the type comprising a first leaf and a second leaf, each leaf having a plate section and a plurality of knuckles extending laterally from the plate section, a retaining pin inserted through the knuckles of the first leaf and second leaf to connect the two leafs, and the first leaf securely anchored, the method comprising the steps of:

(a) removing the retaining pin from the knuckles of the first leaf and the second leaf;

(b) slipping a hinge adjustment tool over the knuckles of the first leaf, the hinge adjustment tool comprising: (i) a head having a first end and a second end, the head further comprising a first jaw portion and an opposite-facing second jaw portion, the first jaw portion and the second jaw portion defining a knuckle-enclosing opening, the knuckle-enclosing opening having a slot shape at the first end, transitioning into a circular shape as the knuckle-enclosing opening extends in the direction of the second end and (ii) a handle attached to the second end of the head;

(c) applying a force to the handle to change the angle between the knuckles of the first leaf and the plate section of the first leaf until a desired angle is achieved;

(d) removing the hinge adjustment tool from the knuckles of the first leaf; and (e) reinserting the retaining pin into the aligned knuckles of the first leaf and the second leaf.

15. The method of claim 14 wherein the head of the hinge adjustment is attached to the handle with a threaded connection.

16. The method of claim 14 wherein the head of the hinge adjustment tool is cylindrical in shape.

17. The method of claim 16 wherein the first end of the head of the hinge adjustment tool has a beveled edge.

18. The method of claim 16 wherein the second end of the head of the hinge adjustment tool has a beveled edge.

* * * * *